US007341015B2

(12) United States Patent
Bourret et al.

(10) Patent No.: US 7,341,015 B2
(45) Date of Patent: Mar. 11, 2008

(54) WATERCRAFT DRAIN

(75) Inventors: Michel Bourret, Drummondville (CA); Sebastien Clement, St-Elie d'Orford (CA)

(73) Assignee: Bombardier Recreational Products Inc, Valcourt (CA)

( * ) Notice: Subject to any disclaimer, the term of this patent is extended or adjusted under 35 U.S.C. 154(b) by 0 days.

(21) Appl. No.: 11/465,672

(22) Filed: Aug. 18, 2006

(65) Prior Publication Data

US 2007/0095268 A1 May 3, 2007

Related U.S. Application Data

(60) Provisional application No. 60/731,242, filed on Oct. 31, 2005.

(51) Int. Cl.
*B63B 13/00* (2006.01)

(52) U.S. Cl. ..... 114/183 R

(58) Field of Classification Search ..... 114/55.5, 114/197, 183 R

See application file for complete search history.

(56) References Cited

U.S. PATENT DOCUMENTS

| | | | | |
|---|---|---|---|---|
| 3,565,031 | A | 2/1971 | DePersia | |
| 3,726,245 | A | 4/1973 | Critcher | |
| 3,859,945 | A | 1/1975 | Moeller | |
| 3,875,888 | A | 4/1975 | Bier | |
| 4,198,918 | A | 4/1980 | Patriarca | |
| 4,217,846 | A * | 8/1980 | Wight | 114/185 |
| 4,340,006 | A | 7/1982 | Patriarca | |
| 4,787,328 | A | 11/1988 | Inoue | |
| 4,850,908 | A | 7/1989 | Nakase | |
| 4,986,777 | A * | 1/1991 | Preston | 440/88 L |
| 5,419,271 | A | 5/1995 | Tweet | |
| 5,636,586 | A | 6/1997 | Suganuma | |
| 5,881,664 | A | 3/1999 | Suganuma | |
| 5,950,555 | A | 9/1999 | Damask | |
| 6,038,992 | A | 3/2000 | Smith | |
| 6,170,423 | B1 | 1/2001 | Suganuma | |
| 6,506,085 | B1 | 1/2003 | Casey | |
| 6,615,760 | B1 * | 9/2003 | Wise et al. | 114/197 |
| 6,634,312 | B2 * | 10/2003 | Warner et al. | 114/197 |
| 7,117,806 | B2 * | 10/2006 | Kamio et al. | 114/55.51 |
| 2002/0073910 | A1 * | 6/2002 | Yamada et al. | 114/363 |

* cited by examiner

*Primary Examiner*—Ed Swinehart
(74) *Attorney, Agent, or Firm*—Osler, Hoskin & Harcourt LLP

(57) ABSTRACT

A watercraft drain assembly has a tubular drain body having a first end and a second end, at least one inlet opening disposed on the drain body for allowing water to enter the drain body, a first outlet opening disposed at the first end of the drain body for allowing water to exit the drain body, a drain plug for selectively plugging the first outlet opening, and a second outlet opening disposed on the drain body for allowing water to exit the drain body. A watercraft incorporating the watercraft drain assembly is also disclosed.

20 Claims, 10 Drawing Sheets

SECTION A - A

WATERCRAFT DRAIN

CROSS-REFERENCE

This application claims priority to U.S. Provisional Patent Application 60/731,242, filed Oct. 31, 2005, entitled "Watercraft Drain", the entirety of which is incorporated herein by reference.

FIELD OF THE INVENTION

The present invention relates to a watercraft drain assembly and a watercraft incorporating the watercraft drain assembly.

BACKGROUND OF THE INVENTION

Watercraft manufacturers attempt to design their watercraft so as to prevent water from entering the hull. Regardless of these attempts, during operation of the watercraft, some water will enter the watercraft either through the air intakes for the engine, the engine compartment ventilation openings, an improper seal between two elements of the watercraft, or some other opening. Water entering the hull, if left unaddressed, may cause some elements normally found inside the hull, such as electronics or the engine, to malfunction, could cause corrosion, and, in extreme cases, may compromise the buoyancy of the watercraft.

To address this problem, watercraft manufacturers typically use two devices. The first one is a drain assembly located on the hull to drain the water out of the watercraft hull when the watercraft is removed from the water, such as when it is placed in dry docks for repair, placed in storage, or placed on a trailer to move it from one body of water to another. The second device is a bailer or a pump used to remove the water from the watercraft hull when the watercraft is on a body of water.

FIGS. 2A to 3B illustrate a prior art drain assembly 36. The drain assembly 36 is attached to the hull 10 so as to create a passage between an interior and the exterior of the hull 10. This is done by fastening a flange 39 of the drain assembly 36 to the transom 12 by using fasteners 35 placed through holes 38 found in the flange 39. The drain assembly 36 is located as low as possible on the transom 12 in order to maximize the amount of water that can be drained from the hull 10. The drain assembly 36 essentially consists of a cylindrical drain body 37 which is opened at both ends. One end of the drain body (the outlet) communicates with the exterior of the hull 10 and the other end (the inlet) communicates with the interior of the hull 10. A removable plug 30 is placed in the outlet to prevent water from entering the hull 10 when the watercraft 8 is in the water since the drain assembly 36, due to its location, is normally below the waterline 13. To drain the hull 10 when the watercraft 8 is outside the water, the plug 30 is removed and any water which is above the inlet is drained to the exterior of the hull 10. A restraint 34, connected to the plug 30, links the plug 30 to the drain body 37 when it is removed therefrom to prevent the loss of the plug 30. A check valve in the form of a ball 33 is placed inside the drain body 37. Should a user of the watercraft 8 forget to replace the plug 30 in its position in the drain body 37 when the watercraft 8 is put back in a body of water, the water pressure pushes the ball 33 towards the inlet to seal it, thus preventing water from entering the hull 10. However, since the inlet has a smaller diameter than the outlet, the ball does not prevent the flow of water from the inlet of the drain body 37 to the outlet of the drain body 37. The restraint 34 prevents the ball 33 from falling out of the outlet.

FIG. 4 illustrates a prior art bailer system. A pair of bailers 22 having holes 42 are attached to the bottom of the hull 10 by using belts 20 and fasteners 21. The bailers 22 are located in the locations where water is most likely to pool inside the hull 10. The bailers 22 are connected to a jet pump 18 of the watercraft 8 though a series of hoses 23 and elbows 25 held together by tie wraps 24. When the watercraft 8 is in operation, the water passing through the jet pump 18 at high speed creates a low pressure which is used by the bailers 22 to aspirate water located near them through the holes 42. The water then flows through the hoses 23 and is expelled in the jet pump 18. Check valves 32 are placed between hoses 23 to prevent water from entering the hull 10 via the bailers 22. Other prior art bailer systems use electrical or mechanical pumps to aspirate water through the bailers 22.

The drain assembly 36 and the bailers 22 described above can both remove water from the hull of a watercraft, however the drain assembly 36 can only be used when the watercraft is outside the water, and the bailers 22 can only be used when the watercraft is operational (in the case where the suction from the jet pump is used) or when the pump attached to the bailers is operational. For this reason, most watercraft are equipped with both a drain and a bailer system. This dual system approach creates a lot of parts which need to be assembled, which ultimately increases the cost of the watercraft.

Therefore, there is a need for a different device for draining water from the hull of a watercraft.

STATEMENT OF THE INVENTION

One aspect of the invention provides a watercraft drain assembly which incorporates the function of a bailer.

Another aspect of the invention provides a watercraft equipped with such a drain assembly.

In another aspect, the invention provides a watercraft drain assembly having a tubular drain body. The tubular drain body has a first end and a second end. At least one inlet opening is disposed on the drain body for allowing water to enter the drain body. A first outlet opening is disposed at the first end of the drain body for allowing water to exit the drain body. A drain plug is provided for selectively plugging the first outlet opening. A second outlet opening is disposed on the drain body for allowing water to exit the drain body.

In an additional aspect, the at least one inlet opening is disposed at the second end of the drain body.

In a further aspect, the second outlet opening is disposed at the second end of the drain body.

In an additional aspect, the at least one inlet opening is a plurality of inlet openings forming a strainer.

In a further aspect, the drain assembly has a check valve for preventing water from exiting the drain body through the at least one inlet opening.

In yet a further aspect, the check valve is a ball disposed inside the drain body. The ball moves to a first position preventing fluid communication from the drain body to the at least one inlet opening when water enters the drain body from at least one of the first and second outlet openings, and the ball moves to a second position allowing fluid communication from the at least one inlet opening to the drain body when water enters the drain body from the at least one inlet opening.

In an additional aspect, the drain assembly has a flange located at the first end of the drain body for mounting the drain assembly to a watercraft.

In another aspect, the invention provides a watercraft having a hull. The hull has a transom. A propulsion unit is mounted to the hull. An engine is operatively connected to the propulsion unit for powering the propulsion unit. At least one drain assembly is mounted to the hull for fluidly communicating an interior of the hull with an exterior of the hull. The drain assembly has tubular drain body having a first end passing through the transom and a second end extending in the interior of the hull, at least one inlet opening disposed on the drain body for fluidly communicating the interior of the hull with the drain body, a first outlet opening disposed at the first end for fluidly communicating the drain body with the exterior of the hull, a drain plug for selectively plugging the first outlet opening, and a second outlet opening disposed on the drain body. The watercraft also has a hose fluidly connected to the second outlet opening for fluidly communicating the drain body with the exterior of the hull.

In a further aspect, the propulsion unit is a jet pump and the hose fluidly communicates the drain body with the jet pump such that when the jet pump is powered by the engine, water present in the hull near the at least one drain assembly is aspirated through the at least one inlet opening to the drain body, exits the drain body through the second inlet opening, and flows through the hose to the jet pump unit.

In yet another aspect, the watercraft has a pump in fluid communication with the hose for pumping water present in the hull near the drain assembly through the at least one inlet opening, to the drain body, and through the second inlet opening, through the hose to the exterior of the hull.

In an additional aspect, a check valve is fluidly connected to the hose to prevent flow of water from the hose to the drain body via the second outlet.

In a further aspect, the at least one drain is two drain assemblies, and the two drain assemblies are mounted to the transom on different sides of a longitudinal centerline of the watercraft.

In an additional aspect, the watercraft has a deck mounted on the hull, a straddle seat mounted to the deck, and handlebars disposed forwardly of the straddle seat for steering the watercraft.

Embodiments of the present invention each have at least one of the above-mentioned aspects, but do not necessarily have all of them.

Additional and/or alternative features, aspects, and advantages of the embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE INVENTION

Although the present invention is being described herein with respect to a straddle type personal watercraft propelled by a jet pump, it is contemplated that the invention could also be applied to other types of watercraft, such as boats and stand-up personal watercraft, using the same or other types of propulsion, such as propellers.

Figure 1:
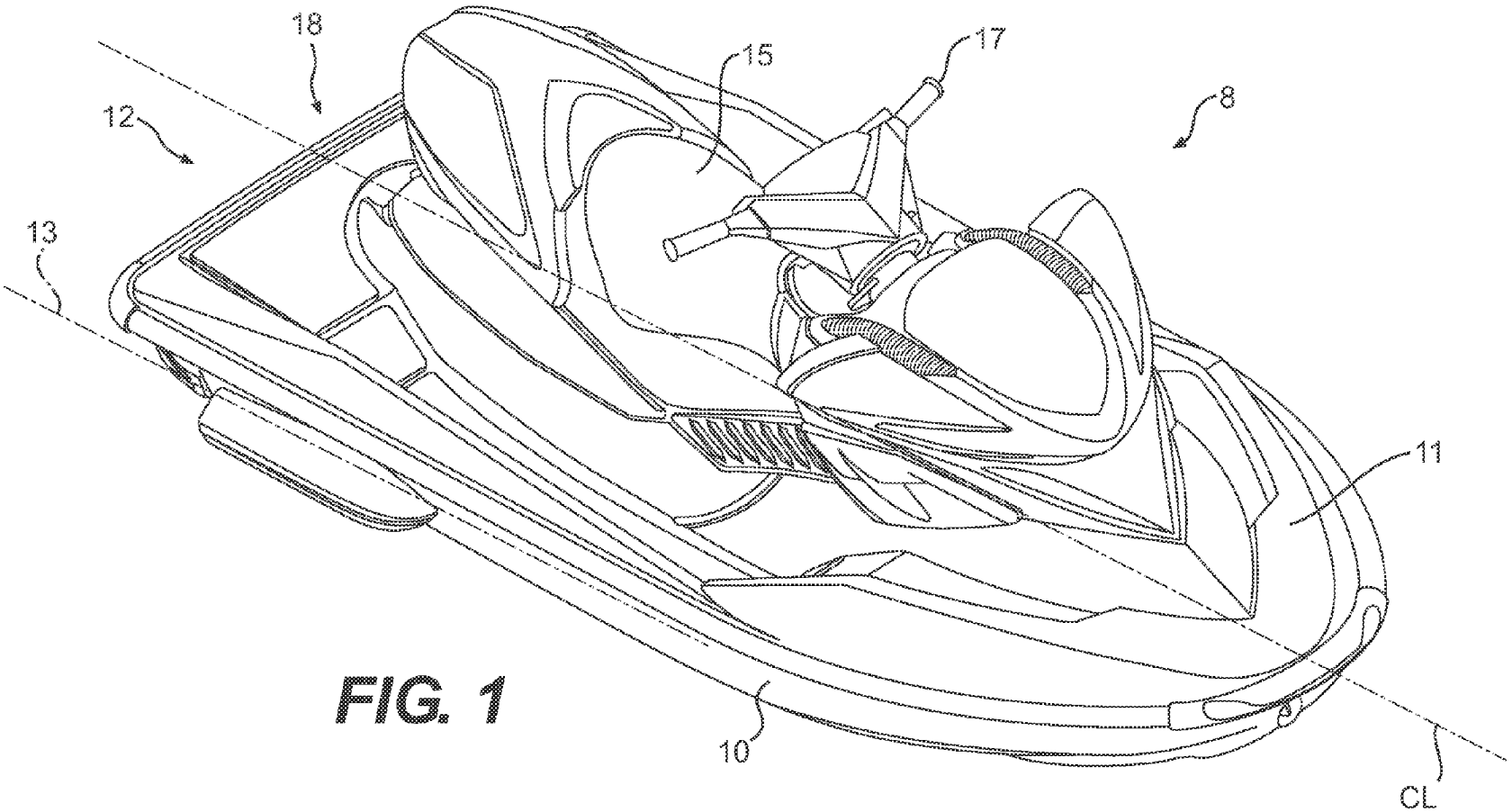
FIG. 1 is a perspective view, taken from a front, right side, of a personal watercraft.
Figure 2A:
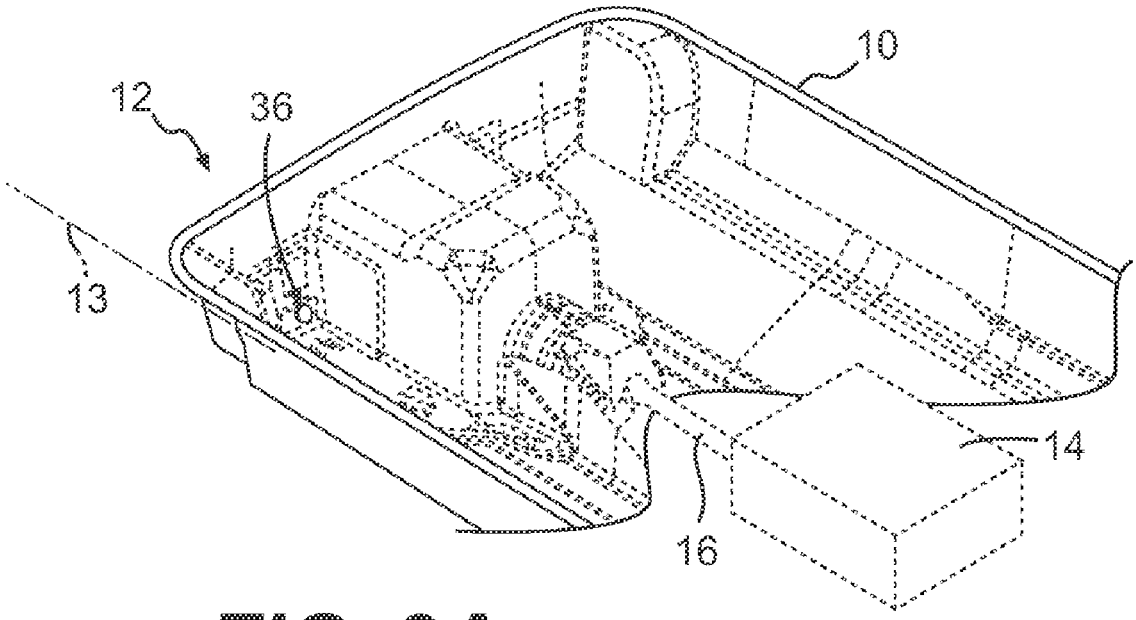
FIG. 2A PRIOR ART
FIG. 2A is a partial view of a hull of a watercraft with a prior art watercraft drain assembly attached to a transom thereof.
Figure 2B:
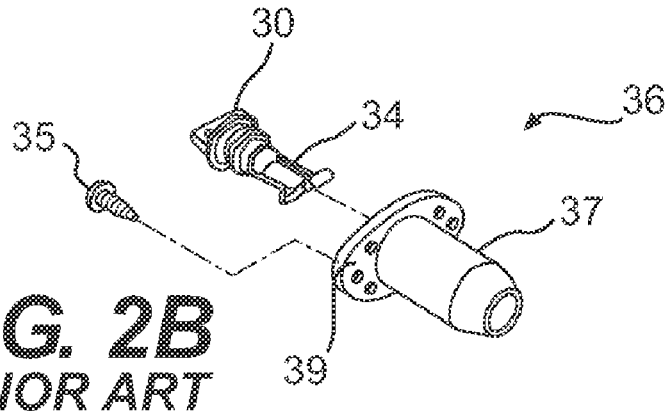
FIG. 2B PRIOR ART
FIG. 2B is an exploded view of a prior art watercraft drain assembly.
Figure 3B:
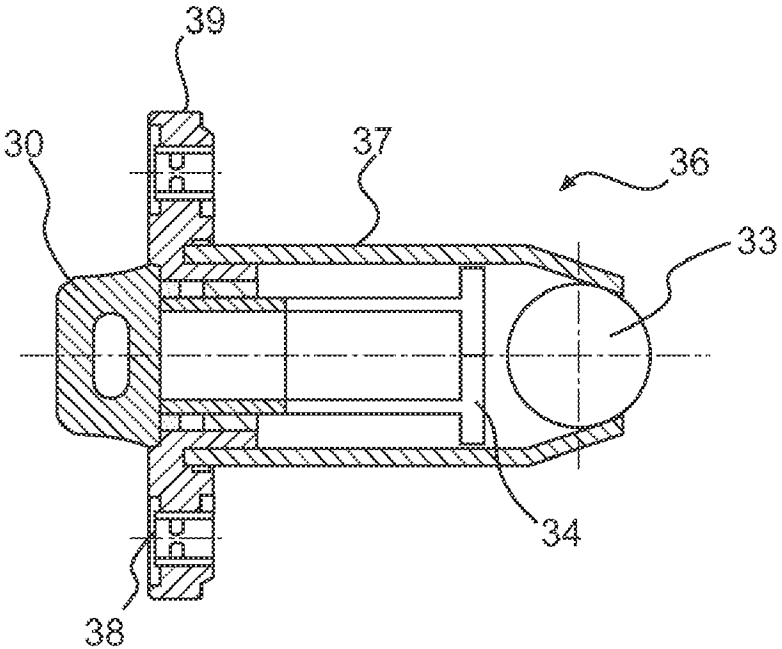
FIG. 3B PRIOR ART
FIG. 3B is a cross-section, taken through line A-A of FIG. 3A, of the watercraft drain assembly of FIG. 2B.
Figure 3A:
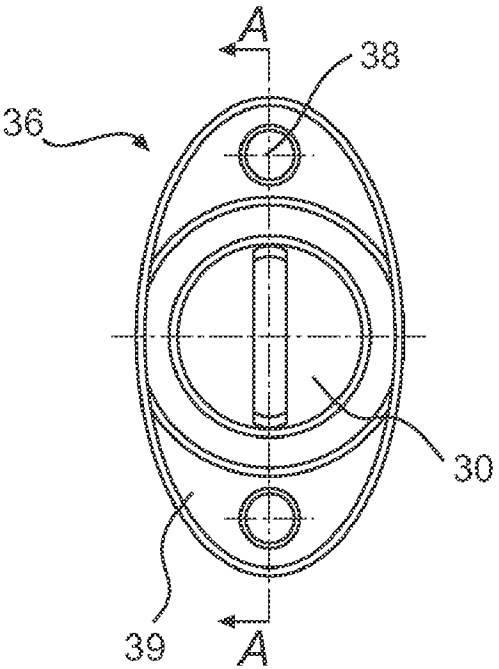
FIG. 3A PRIOR ART
FIG. 3A is an end view of the watercraft drain assembly of FIG. 2B.
Figure 4:
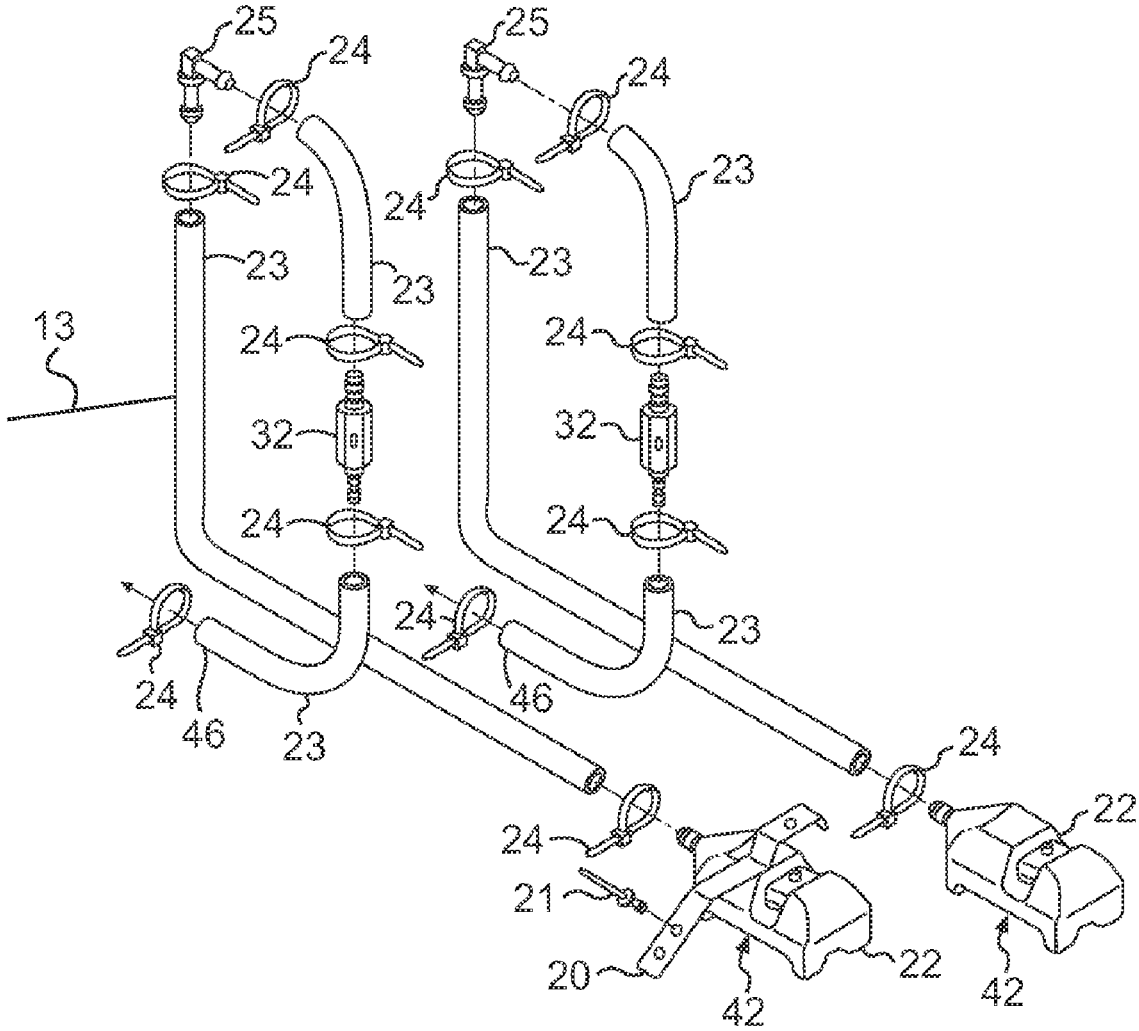
FIG. 4 PRIOR ART
FIG. 4 is an exploded view of a prior art bailer system.
Figure 6:
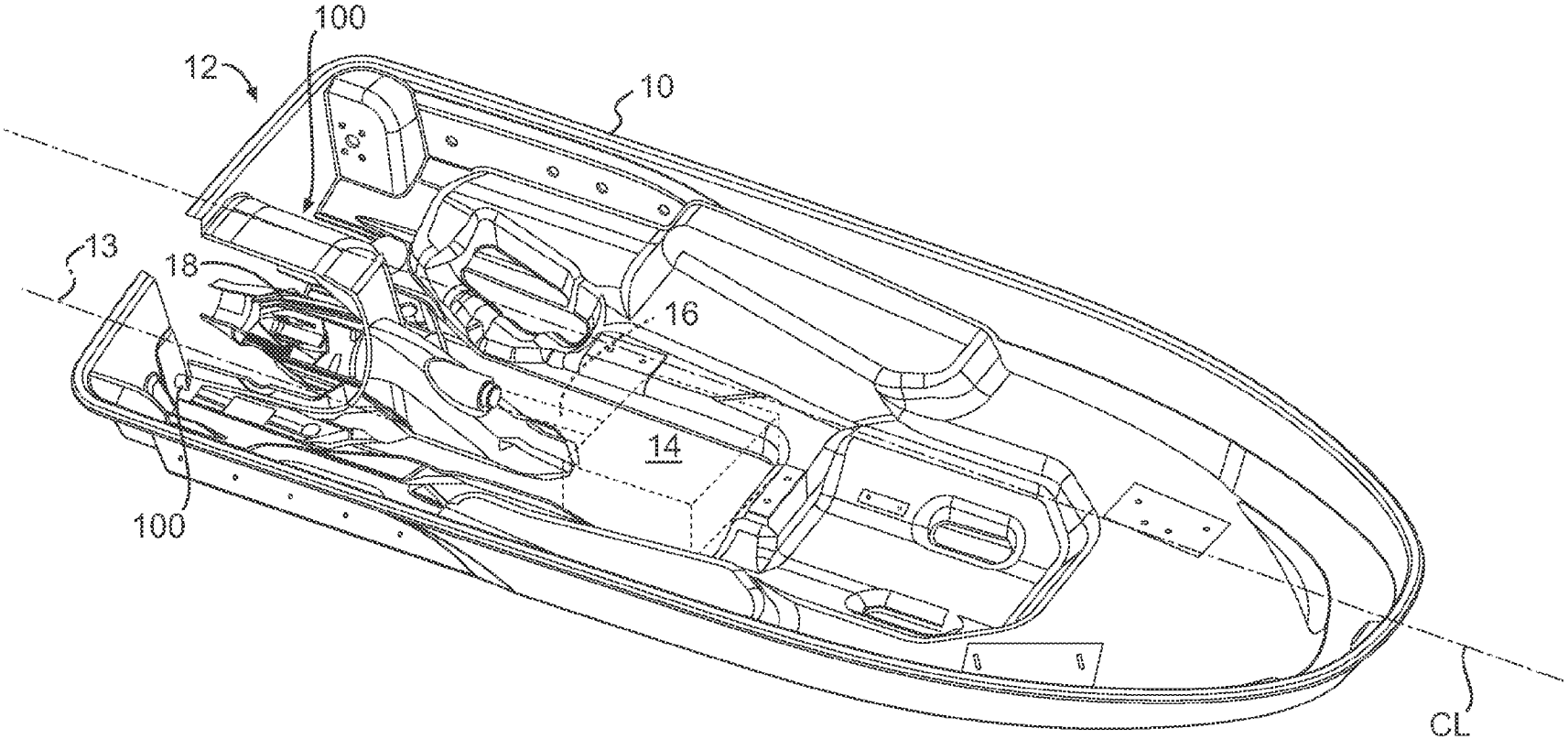
FIG. 6 is a partial view of a hull of a watercraft with the watercraft drain assembly of FIG. 5A attached to a transom thereof.

FIG. 1 illustrates a personal watercraft 8 with which a drain assembly 100 of the present invention can be used. The personal watercraft 8 has a hull 10 and a deck 11 disposed on the hull 10. The hull 10 has a transom 12 at the rear thereof. The hull 10 and deck 11 together define a compartment in which the engine 14 (FIG. 6) of the watercraft 8 is disposed. A straddle seat 15 is disposed on the deck 11 to accommodate a driver of the watercraft 8. Depending on its length, the straddle seat 15 may accommodate one or more passengers behind the driver. The straddle seat 15 is preferably removable to allow access to the engine 14. Handlebars 17 are disposed on the deck 11 forwardly of the straddle seat 15 to permit steering of the watercraft 8 as described below. The watercraft 8 is propelled by a propulsion unit in the form of a jet pump 18 located at the rear of the watercraft 8. Other types of propulsion units, such as propellers, are also contemplated. The jet pump 18 is powered by the engine 14 via a driveshaft 16 (FIG. 6). Turning the handlebars 17 causes a steering nozzle 146 (FIG. 8) of the jet pump 18 to turn about a vertical axis which redirects the flow of water coming from the jet pump 18, thus causing the watercraft 8 to turn. When the watercraft 8 is disposed in water, the level of the water relative to the watercraft 8 is schematically indicated throughout the figures by waterline 13.

Figure 5A:
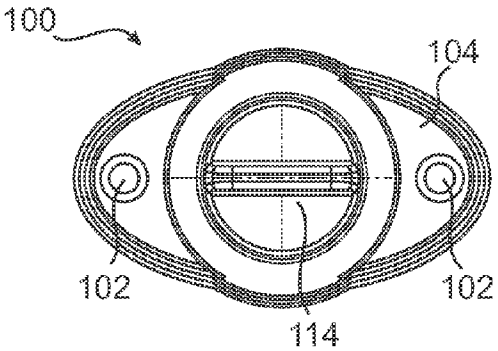
FIG. 5A is an end view of a watercraft drain assembly in accordance with the present invention.
Figure 5C:
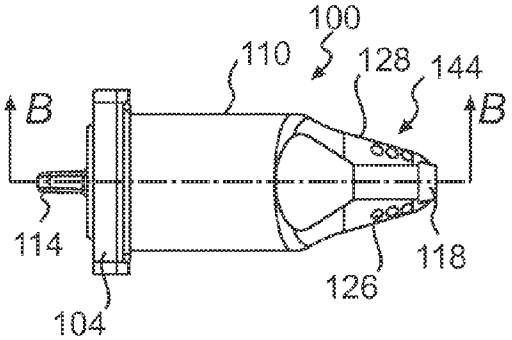
FIG. 5C is a side elevation view of the watercraft drain assembly of FIG. 5A.
Figure 5B:
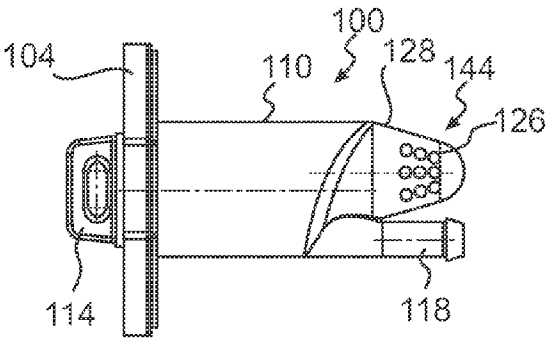
FIG. 5B is a top view of the watercraft drain assembly of FIG. 5A.
Figure 5D:
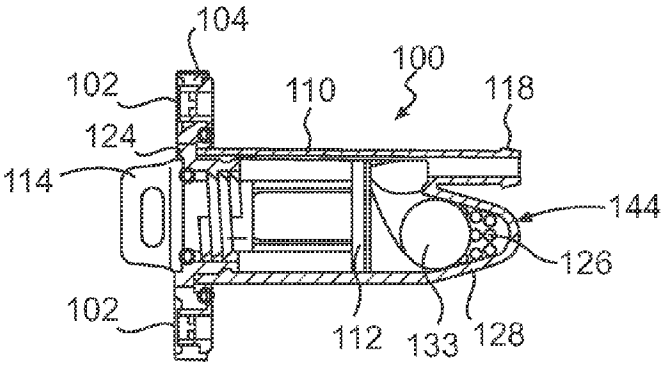
FIG. 5D is a cross-section, taken through line B-B of FIG. 5C, of the watercraft drain assembly of FIG. 5A with the plug inserted in the drain body.
Figure 5E:
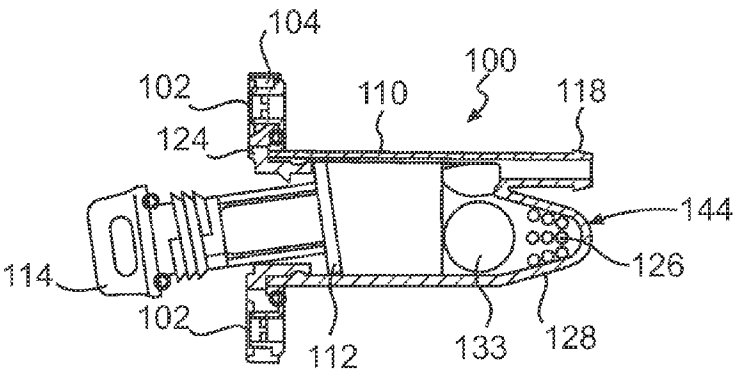
FIG. 5E is a cross-section, taken through line B-B of FIG. 5C, of the watercraft drain assembly of FIG. 5A with the plug removed from the drain body.
Figure 8:
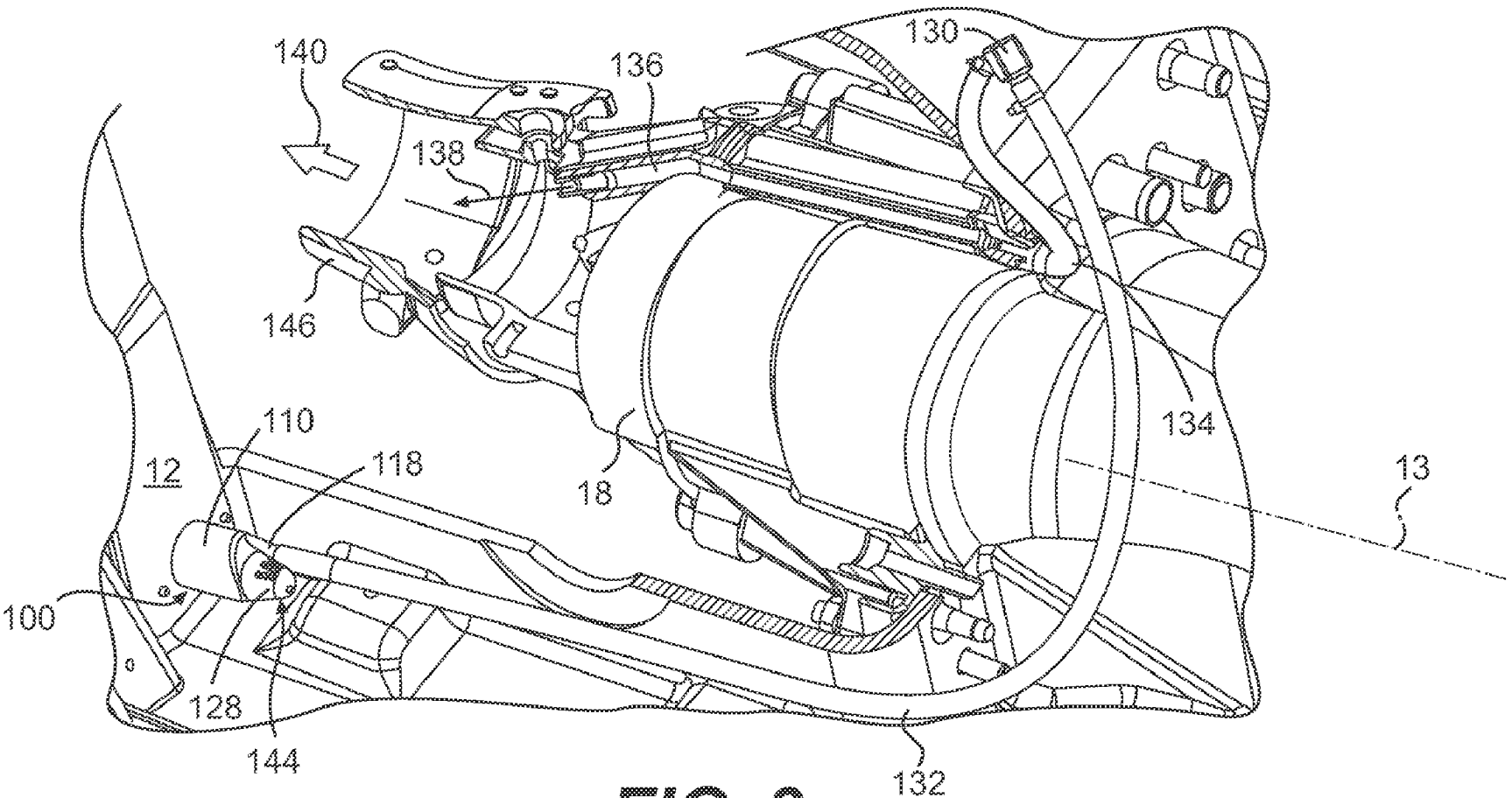
FIG. 8 is a partial cross-section of a jet pump with the watercraft drain assembly of FIG. 5A fluidly connected thereto.

Turning now to FIGS. 5A to 5E, the drains assembly 100 of the present invention has a tubular drain body 110. The components of the drain assembly 100 are preferably made of plastic. A flange 104 is located at a first end of the drain body 110. Holes 102 permit the attachment of the flange 104 to the transom 12 of the watercraft 8 by using fasteners (not shown). When the drain assembly 100 is attached to the transom 12, the drain body 110 extends inside the hull 10, as seen in FIG. 8. The drain assembly 100 is preferably positioned on the transom 12 as close as possible to the bottom of the hull 10 in order to allow the most water to be drained from the hull 10. A drain outlet 124 is disposed at the first end of the drain body 110. A threaded plug 114 is used to open (FIG. 5E) and close (FIG. 5D) the drain outlet 124 as will be described below. A restraint 112 is integrally formed with the plug 114 to prevent the plug 114 from becoming separated from the drain assembly 100, as shown in FIG. 5E, thus reducing the likelihood of losing the plug 114.

A bailer outlet 118 is located at the other end of the drain body 110. The bailer outlet 118 is in the form of a tube having a tapered protrusion at its end to permit a hose, such as hose 132 shown in FIG. 7, to be disposed and retained thereon. The bailer outlet 118 is integrally formed with the drain body 110 and, as shown in FIG. 5D, is continuous with the outside wall of the drain body 110. When attaching the drain assembly 100 to the transom 12 of the hull 10, this also facilitates the insertion of the drain assembly 100 through the hole made in the transom 12 to receive the drain assembly 100.

The inlet 144 of the drain assembly 100 is located at the same end of the drain body 110 as the bailer outlet 118. The inlet 144 has a tapered portion 128. The angle of taper of the tapered portion 128 is preferably not too acute, as this may cause the ball 133 described below to become stuck in the tapered portion 128. The tapered portion 128 has a plurality of inlet openings 126 forming a strainer. The diameter of each inlet opening 126 is smaller than the diameter of the bailer outlet 118. This prevents large debris from entering the drain body 110 through the inlet openings 126, thus ensuring that the bailer outlet 118 does not get clogged.

A ball 133, preferably made of plastic, is disposed inside the drain body 110. The ball 133 moves inside the drain body 110 and acts as a check valve to prevent water to flow from either one of the drain outlet 124 and the bailer outlet 118 to the interior of the hull 10 via inlet openings 126, as will be explained below.

When the watercraft 8 is operated in water, any water entering the hull 10 moves towards the back of the hull 10 since it is normally the lowest point during operation. As shown in FIG. 6, two drain assemblies 100, each one located on a different side of a longitudinal centerline CL of the watercraft 8, are preferably used since water will pool in the hull 10 on either sides of the jet pump 18. During operation of the watercraft 8, when the water reaches the level of the drain assembly 100, it gets aspirated through the inlet openings 126, enters the drain body 110, and leaves the drain body 110 through bailer outlet 118. In this condition, the flow of water causes the ball 133 to move away from the tapered portion 128, thus allowing fluid communication between the inlet openings 126 and the bailer outlet 118. From the bailer outlet 118, the water is sent back to the body of water. The aspiration can be obtained in various ways, some of which are described below.

Figure 7:
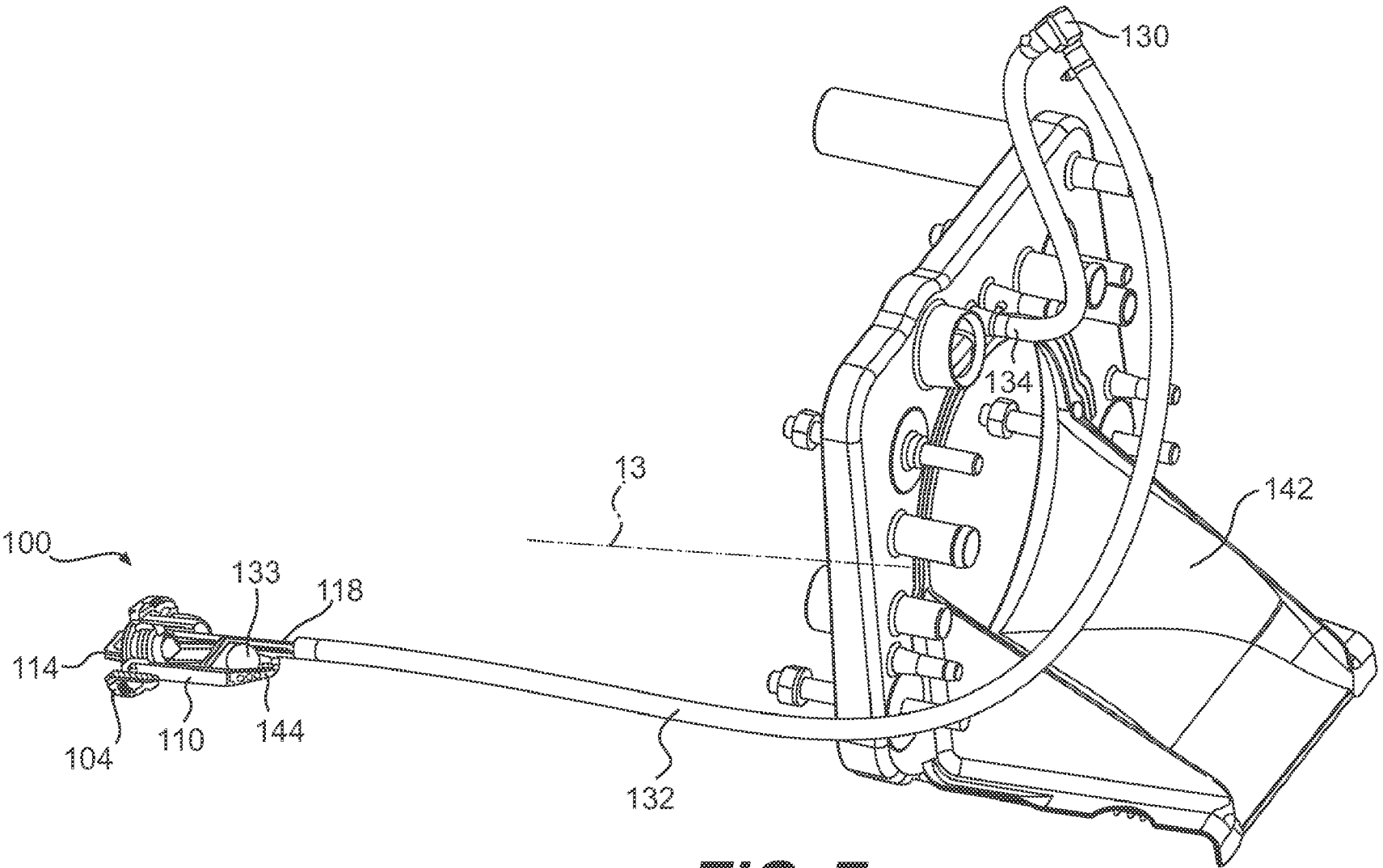
FIG. 7 is a perspective view, taken from a front, right side, of the watercraft drain assembly of FIG. 5A fluidly connected to a jet pump support of a watercraft.

As shown in FIGS. 7 and 8, the aspiration can be obtained by connecting the bailer outlet 118 to a point in the jet pump 18 where a low pressure is created when it is powered by the engine 14. A hose 132 connects the bailer outlet 118 to an elbow 130 which is connected to the jet pump support 142 by hose 134. As shown in FIG. 8, the point where hose 134 connects with the jet pump support 142 fluidly communicates with a passage 136 located in a wall of the jet pump 18. The end of passage 136 opens inside the jet pump 18 at point where the speed of the water flowing inside the jet pump 18 during its operation creates a low pressure. It is this low pressure which permits the aspiration of the water through the drain assembly 100. Therefore, when the watercraft 8 is in operation, water present in the hull 10 near the drain assembly 100 is first aspirated through the inlet openings 126 to the bailer outlet 118 as described above. The water then flows through hose 132, elbow 130, and hose 134. From hose 134, water flows through the passage 136 to the inside of the jet pump 18 (location 138) and is expelled to the body of water with the water (140) flowing through the jet pump 18.

Locating elbow 130 above the waterline 13 helps ensuring that water does not flow from the body of water back to the drain assembly 100 when the jet pump 18 is not operating. Should any water flow back through hoses 134 and 132, the water entering the drain body 110 via the bailer outlet 118 would push the ball 133 towards the tapered portion 128 as shown in FIG. 5D, thus preventing water from entering the hull 10 via the inlet openings 126.

Figure 9:
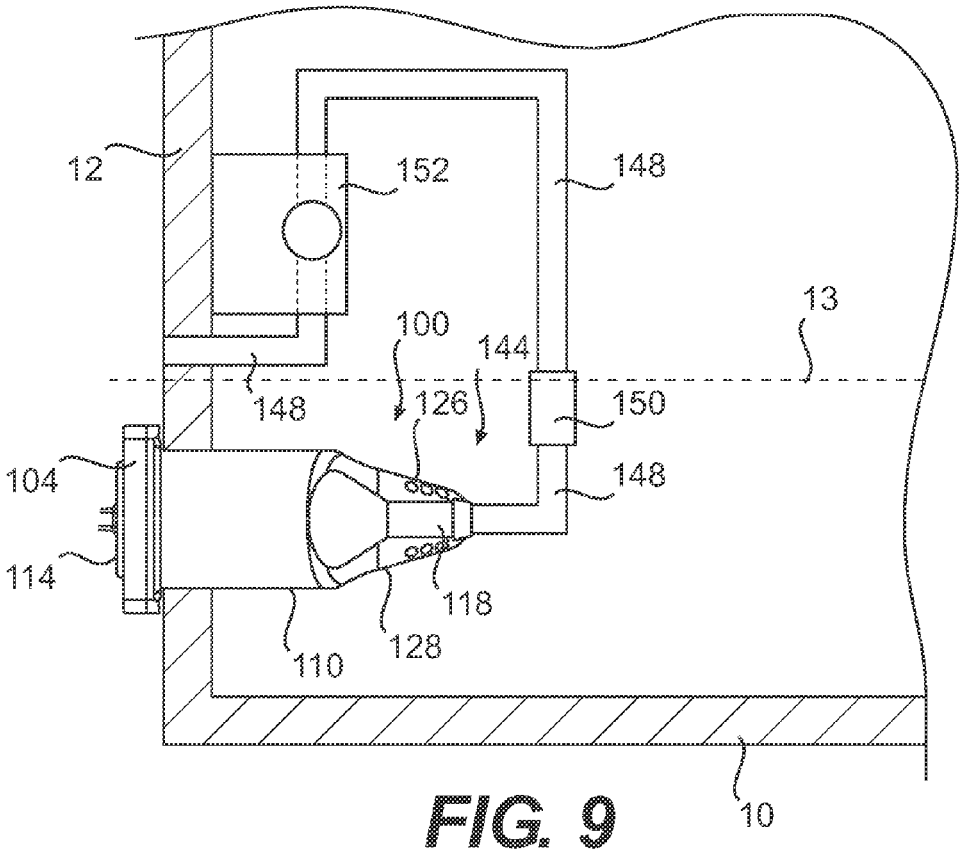
FIG. 9 is a schematic illustration of an alternative embodiment of a watercraft water removal system using the watercraft drain assembly of FIG. 5A.

FIG. 9 illustrates an alternative way in which water collecting inside the hull 10 can be aspirated by using the drain assembly 100. The bailer outlet 118 is connected to a hose 148 which connects to a water pump 152. From the water pump 152, the hose 148 goes through the transom 12 above the waterline 13. The water pump 152 is preferably an electrical pump which can be operated even when the watercraft 8 is not operated. Other types of water pumps are also contemplated, such as a mechanical pump driven by the engine 14. When the water pump 152 is operated, water present in the hull 10 near the drain assembly 100 is first aspirated through the inlet openings 126 to the bailer outlet 118 as described above. The water then flows through hose 148 to the water pump 152 and is then expelled back to the body of water. As can be seen in FIG. 9, the hose 148 extends above the waterline 13 to help ensuring that water does not flow from the body of water back to the drain assembly 100 when the water pump 152 is not operating. As explained above with respect to claims 7 and 8, the ball 133 would prevent water from entering the hull 10 via the inlet openings 126 should any water flow back through the hose 148. Alternatively, a check valve in the form of a one way valve 150 can be provided to prevent the flow of water back towards the drain assembly 100.

Figure 10:
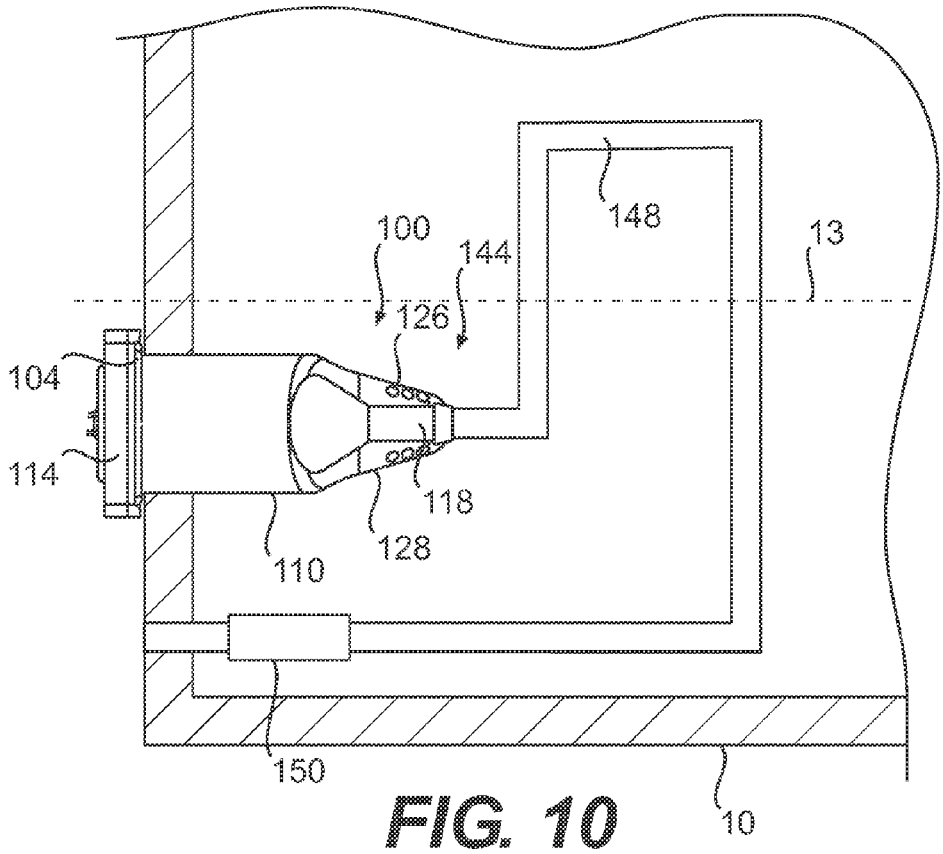
FIG. 10 is a schematic illustration of another alternative embodiment of a watercraft water removal system using the watercraft drain assembly of FIG. 5A.

FIG. 10 illustrates yet another way in which water collecting inside the hull 10 can be aspirated by using the drain assembly 100. The bailer outlet 118 is connected to a hose 148 which passes through the transom 12. The position where the hose 148 passes through the transom 12 is selected such that it is located in a region where a low pressure wake is created when the watercraft 8 is moving forward. Thus, when the watercraft 8 moves forward, the low pressure wake causes water present in the hull 10 near the drain assembly 100 to first be aspirated through the inlet openings 126 to the bailer outlet 118 as described above. The water then flows through hose 148 and is expelled in the body of water. Since the open end of hose 148 is located below the waterline 13, a check valve in the form of a one way valve 150 is preferably provided to prevent the flow of water back towards the drain assembly 100. For the same reasons as those described above with respect to FIG. 9, the hose 148 extends above the waterline 13 and the ball 133 would prevent water from entering the hull 10 via the inlet openings 126 should any water flow back through the hose 148.

When the watercraft 8 is removed from the water to be placed on a trailer or for repairs, water present in the hull 10 can be drained from the hull 10 by simply removing the plug 114 as shown in FIG. 5E. When this is done, any water present in the hull 10 near the drain assembly 100 above the inlet openings 126 will flow through the inlet openings 126, through the drain body 110, and finally to the exterior of the hull 10 through drain outlet 124. The restraint 112 prevents the ball 133 from falling out of the drain body 110. Since the drain assembly 100 is located on the transom 12 at a position normally below the waterline 13 when the watercraft 8 is in water, the plug 114 should be placed back in the drain outlet 124 before putting the watercraft 8 back in the water. However, should a user of the watercraft 8 forget to replace the plug 114 in its position in the drain outlet 124 when the watercraft 8 is put back in a body of water, the water pressure from the water entering through the drain outlet 124 pushes the ball 33 towards the tapered portion 128, thus preventing water from entering the hull 10 through inlet 126.

Figure 11:
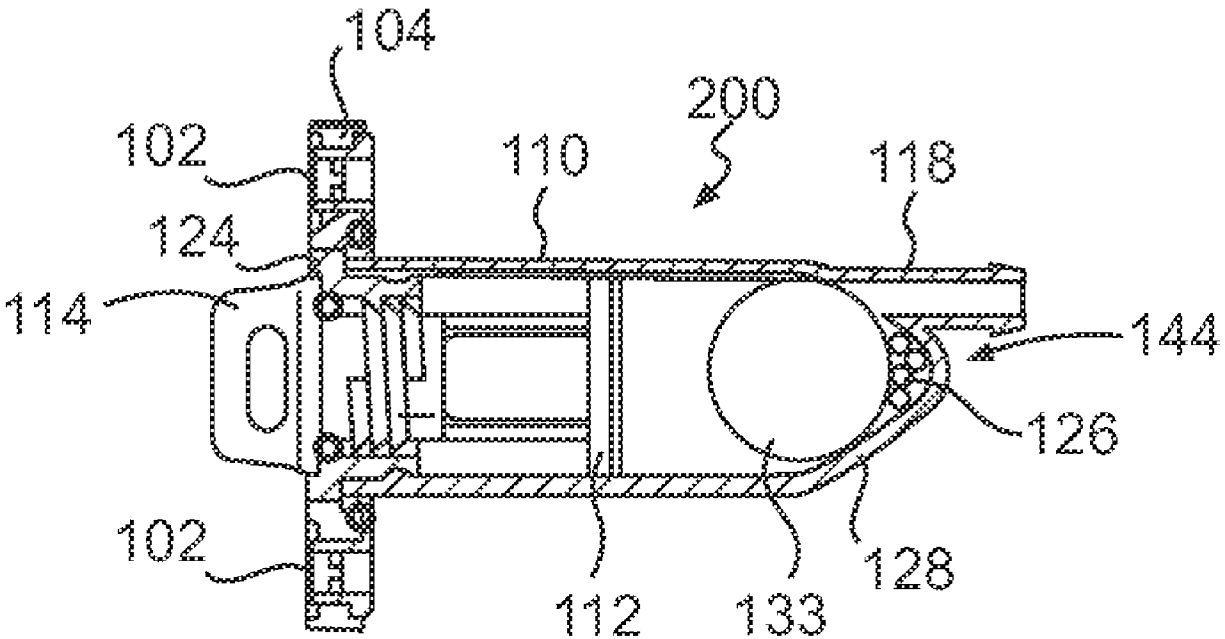
FIG. 11 is a cross-section of an alternative embodiment of a watercraft drain assembly.

FIG. 11 illustrates an alternative embodiment of a drain assembly 200. Like elements between drain assembly 100 and drain assembly 200 have been labelled with the same reference numerals and will therefore not be described again. In drain assembly 200, the bailer outlet 118 is located on the tapered portion 128. Therefore, when the ball 133 is pushed against the tapered portion 128 to prevent water from entering the hull 10 (because the plug 114 was not inserted in the drain outlet 124 before placing the watercraft 8 back in the water), water can still be aspirated through inlet openings 126 since they are still fluidly communicating with the bailer outlet 118. However, since the ball 133 can no longer prevent water from flowing back in the hull 10 through bailer outlet 118, the drain assembly 200 is preferably used with a hose connected to the bailer outlet 118 that has a check valve such as one way valves 150 shown in FIGS. 9 and 10.

As can be understood by the above description, both drain assembly 100 and drain assembly 200 integrate in a single assembly the functions previously found in two different assemblies (a drain assembly and a bailer assembly), which advantageously reduces the number of parts necessary for effectively draining the hull of a watercraft.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft drain assembly comprising:

a tubular drain body having a first end and a second end;

at least one inlet opening disposed on the drain body for allowing water to enter the drain body;

a first outlet opening disposed at the first end of the drain body for allowing water to exit the drain body;

a drain plug for selectively plugging the first outlet opening; a second outlet opening disposed on the drain body for allowing water to exit the drain body; and a check valve for preventing water from exiting the drain body through the at least one inlet opening;

wherein the check valve is a ball disposed inside the drain body, wherein the ball moves to a first position preventing fluid communication from the drain body to the at least one inlet opening when water enters the drain body from at least one of the first and second outlet openings, and wherein the ball moves to a second position allowing fluid communication from the at least one inlet opening to the drain body when water enters the drain body from the at least one inlet opening.

2. The drain assembly of claim 1, wherein the at least one inlet opening is disposed at the second end of the drain body.

3. The drain assembly of claim 2, wherein the second outlet opening is disposed at the second end of the drain body.

4. The drain assembly of claim 2, wherein the at least one inlet opening is a plurality of inlet openings forming a strainer.

5. The drain assembly of claim 4, wherein the second end of the drain body has a tapered portion and the strainer is part of the tapered portion.

6. The drain assembly of claim 4, wherein a diameter of each of the plurality of inlet openings is less than a diameter of the second outlet opening.

7. The drain assembly of claim 1, further comprising a flange located at the first end of the drain body for mounting the drain assembly to a watercraft.

8. A watercraft comprising:

a hull having a transom;

a propulsion unit mounted to the hull;

an engine operatively connected to the propulsion unit for powering the propulsion unit;

at least one drain assembly mounted to the hull for fluidly communicating an interior of the hull with an exterior of the hull, the drain assembly comprising:

a tubular drain body having a first end passing through the transom and a second end extending in the interior of the hull;

at least one inlet opening disposed on the drain body for fluidly communicating the interior of the hull with the drain body;

a first outlet opening disposed at the first end for fluidly communicating the drain body with the exterior of the hull;

a drain plug for selectively plugging the first outlet opening; and a second outlet opening disposed on the drain body for fluidly communicating the drain body with the exterior of the hull; and a hose fluidly connected to the second outlet opening for fluidly communicating the drain body with the exterior of the hull;

wherein the propulsion unit is a jet pump and the hose fluidly communicates the drain body with the jet pump such that when the jet pump is powered by the engine, water present in the hull near the at least one drain is aspirated through the at least one inlet opening to the drain body exits the drain body through the second outlet opening, and flows through the hose to the jet pump unit.

9. The watercraft of claim 8, wherein the at least one inlet opening is disposed at the second end of the drain body.

10. The watercraft of claim 9, wherein the second outlet opening is disposed at the second end of the drain body.

11. The watercraft of claim 9, wherein the at least one inlet opening is a plurality of inlet openings forming a strainer.

12. The watercraft of claim 8, further comprising a check valve for preventing water from exiting the drain body through the at least one inlet opening.

13. The watercraft of claim 12, wherein the check valve is a ball disposed inside the drain body, wherein the ball moves to a first position preventing fluid communication from the drain body to the at least one inlet opening when water enters the drain body from at least one of the first and second outlet openings, and wherein the ball moves to a second position allowing fluid communication from the at least one inlet opening to the drain body when water enters the drain body from the at least one inlet opening.

14. The watercraft of claim 12, wherein the check valve is fluidly connected to the hose to prevent flow of water from the hose to the drain body via the second outlet.

15. The watercraft of claim 8, wherein the at least one drain assembly is two drain assemblies, and wherein the two drain assemblies are mounted to the transom on different sides of a longitudinal centerline of the watercraft.

16. The watercraft of claim 8, further comprising:

a deck mounted on the hull;

a straddle seat mounted to the deck; and handlebars disposed forwardly of the straddle seat for steering the watercraft.

17. A watercraft comprising:

a hull having a transom;

a propulsion unit mounted to the hull;

an engine operatively connected to the propulsion unit for powering the propulsion unit;

at least one drain assembly mounted to the hull for fluidly communicating an interior of the hull with an exterior of the hull, the drain assembly comprising:

a tubular drain body having a first end passing through the transom and a second end extending in the interior of the hull;

at least one inlet opening disposed on the drain body for fluidly communicating the interior of the hull with the drain body;

a first outlet opening disposed at the first end for fluidly communicating the drain body with the exterior of the hull;

a drain plug for selectively plugging the first outlet opening; and a second outlet opening disposed on the drain body for fluidly communicating the drain body with the exterior of the hull;

a hose fluidly connected to the second outlet opening for fluidly communicating the drain body with the exterior of the hull; and a pump in fluid communication with the hose for pumping water present in the hull near the drain assembly through the at least one inlet opening, to the drain body, and through the second outlet opening, through the hose to the exterior of the hull.

18. The watercraft of claim 17, wherein the at least one inlet opening is disposed at the second end of the drain body.

19. The watercraft of claim 17, further comprising a check valve for preventing water from exiting the drain body through the at least one inlet opening.

20. The watercraft of claim 19, wherein the check valve is a ball disposed inside the drain body, wherein the ball moves to a first position preventing fluid communication from the drain body to the at least one inlet opening when water enters the drain body from at least one of the first and second outlet openings, and wherein the ball moves to a second position allowing fluid communication from the at least one inlet opening to the drain body when water enters the drain body from the at least one inlet opening.

* * * * *